US005322270A

United States Patent [19]

Belanger et al.

[11] Patent Number: 5,322,270

[45] Date of Patent: Jun. 21, 1994

[54] DELIVERY SYSTEMS IN THE FOLDER OF A WEB-FED ROTARY PRINTING MACHINE

[75] Inventors: Roger R. Belanger, Dover, N.H.; Richard B. Mack, York Beach; Gilles L. Fecteau, Saco, both of Me.

[73] Assignee: Heidelberg-Harris GmbH, Heidelberg, Fed. Rep. of Germany

[21] Appl. No.: 730,618

[22] Filed: Jul. 16, 1991

[51] Int. Cl.[5] ..... B65H 29/00

[52] U.S. Cl. ..... 271/187; 271/315; 198/473.1

[58] Field of Search ..... 271/187, 314, 315; 198/473.1, 478.1

[56] References Cited

U.S. PATENT DOCUMENTS

| | | | |
|---|---|---|---|
| 4,861,019 | 8/1989 | Michalik | 271/315 |
| 4,925,179 | 5/1990 | Breton et al. | 271/315 X |
| 5,120,049 | 6/1992 | Fischer | 271/187 X |
| 5,123,638 | 6/1992 | Mutou | 271/187 |
| 5,156,389 | 10/1992 | Novick | 271/187 |

FOREIGN PATENT DOCUMENTS

| | | |
|---|---|---|
| 3113399 | 8/1984 | Fed. Rep. of Germany . |
| 3817804 | 10/1989 | Fed. Rep. of Germany . |

*Primary Examiner*—Robert P. Olszewski
*Assistant Examiner*—Boris Milef
*Attorney, Agent, or Firm*—Herbert L. Lerner; Laurence A. Greenberg

[57] ABSTRACT

A folder delivery apparatus for single or multiple-stream production includes several delivery systems which are operable in parallel and can be driven independently of one another. During operation of the folder as well as during machine standstill, the delivery systems can be simultaneously shifted automatically or manually through adjustment units, in such a way that while adjustment takes place, the distance between the delivery systems can be set as desired within a minimal and a maximal setting position.

9 Claims, 5 Drawing Sheets

DELIVERY SYSTEMS IN THE FOLDER OF A WEB-FED ROTARY PRINTING MACHINE

The invention relates to delivery systems in a folder of a web-fed rotary printing machine.

German Patent DE 38 17 804 C1 discloses a folder delivery apparatus with multi-stream production. In that system multiple, parallel drivable fan sections which laterally adjoin each other are driven independently of one another. At least one guide disk is provided between the fan sections. Outer side disks on both sides of the fan sections can be shifted in axial direction through a toothed rack disposed on a shaft. The guide disks disposed at connection points of both shaft ends can be moved a short distance in axial direction by actuators.

A disadvantage of such a folder delivery apparatus is that the folder must be stopped in order to adjust the fan sections. The loosening and tightening of the individual fan section involves dismantling and reinstalling work to a great extent which is very time-consuming. With every new production order a great deal of time is lost while converting.

An alignment device for edges of a shingled stream of folding products is known from German Patent DE 31 13 399 C2.

Conveyor belts running on rolls and passing a shaking device can be displaced in axial direction through a shear which has at least one joint.

However, in that system only transport tapes on which the already finished folded products are delivered can be adjusted.

It is accordingly an object of the invention to provide delivery systems in the folder of a web-fed rotary printing machine, which overcome the hereinafore-mentioned disadvantages of the heretofore-known devices of this general type and which improve a folder delivery apparatus in such a way that an adjustment of the folded product delivery systems to the folding product format takes place while the folder is in operation. With the product flow being made presettable, automation of a folder can be achieved and thereby make-ready time can be saved.

With the foregoing and other objects in view there is provided, in accordance with the invention, in a folder of a web-fed rotary printing machine, a delivery apparatus, comprising delivery systems for single or multiple-stream production, means for operating the delivery systems in parallel, means for driving the delivery systems independent of one another, means for automatically or manually adjusting the delivery systems during operation of the folder, adjustment units for simultaneously shifting the delivery systems, and means for setting a desired distance between the delivery systems within a minimal and a maximal setting position while adjustment takes place.

An advantage to be seen is that according to the invention, an automatic adjustment of the folder or former together with the fan delivery systems can take place. The make-ready time, in particular the time for adjustment of the delivery systems to new formats, is thereby reduced to a minimum. Thus, with a folder including four fans, a drastic reduction in make-ready time can be achieved. Furthermore, the automatic format adjustment allows the folding product side guides to be disengaged in the start-up phase of printing while delivery of the folding products still is irregular, in order to prevent a paper jam in the folder fans. Thus, the machine operator is free to attend to other monitoring tasks, particularly in the start-up phase of operation.

In accordance with another feature of the invention, the delivery systems include fan disks, belts and delivery belts.

In accordance with a further feature of the invention, there is provided a shaft on which the fan disks are shiftably disposed, arms for for moving the fan disks, and sliding parts fastened to the arms. It is therefore an advantage that each individual fan disk is shifted separately while automatic adjustment to the respective format takes place during operation.

In accordance with an added feature of the invention, there are provided bearings disposed at the fan disks, and rings mounted on the bearings, the arms being fastened on the rings. The advantage of this structure is that the weight of the arms rests on the rings and, due to the bearings, the fan disks are prevented from becoming misaligned while being shifted on the shaft. Thus, no wear occurs between moving parts. The precise mounting of the arms at the fan disks also allows a precise guidance of the fan disks on the shaft.

In accordance with an additional feature of the invention, there is provided a shaft on which the sliding parts or shiftable guide bars are shiftably disposed, and spindle heads moving the sliding parts. This structure has the advantage of permitting costly guide rails to be eliminated and an inexpensive, reliable construction to be implemented.

In accordance with yet another feature of the invention, there are provided folder side walls, bushings supported in the folder side walls, power spindles mounted in the bushings, and an electric motor simultaneously driving the power spindles. The advantage of such a structure is that, for instance, four movable fan disks can be shifted by an adjusting aggregate. The synchronous adjustment of all delivery systems is accomplished in this manner.

In accordance with yet a further feature of the invention, there is provided a shaft on which the sliding parts are shiftably disposed, and spindle heads moving the sliding parts, the power spindles having varying single or multiple-thread threaded sections formed thereon in the vicinity of the spindle heads or having sleeves fastened thereon having one or more thread starts of the same pitch in the vicinity of the spindle heads. In accordance with yet an added feature of the invention, the power spindles have threaded sections milled into the power spindles with varying pitch. It is advantageous that the choice of the threading pitches or thread starts determines a certain proportional setting distance of the fan disks as well as the equal space to be maintained between the individual fan disks during the adjustment operation.

In accordance with yet an additional feature of the invention, there are provided shafts on which the sliding parts are shiftably disposed, and shiftable stoppers fastened to the shafts for accommodating the shiftable sliding parts. The advantageous of such a structure is that a setting distance can be delimited by simple means.

In accordance with again another feature of the invention, there is provided a tubular shaft on which the fan disks are shiftably disposed, spindle heads connected to the fan disks, power spindles mounted in the tubular shaft and cooperating with the spindle heads, an electric motor disposed in the tubular shaft, and a pinion and gear wheels through which the electric motor moves the power spindles. This alternative construction is cost and space-saving, since the adjustment mechanism can be housed in the tubular shaft.

In accordance with again a further feature of the invention, there is provided a lateral folding product guide, an arm connected to the lateral folding product guide, a sliding part connected to the arm, and means for pneumatically actuating the sliding part or an adjusting spindle connected to the sliding part, and a hand wheel connected to the adjusting spindle for manually actuating the sliding part. This structure makes it possible to disengage the lateral folding product guide at the start-up of the folding apparatus, in order to prevent any impairment of the product stream while it still is irregular, and to thereby avoid possible paper jams in the folder. A faster start-up of production is ensured by this inventive feature.

In accordance with again an added feature of the invention, the delivery systems include fan disks having spaces therebetween, conveyor belts extending into the spaces between the fan disks, and means for automatically adjusting the belts simultaneously by a respective format adjustment to be made with the fan disks. This inventive feature permits the delivery systems to be immediately adapted to the varying formats of the folding products, and ensures that optimal transport and delivery conditions for the folding products are thereby obtained.

In accordance with again an additional feature of the invention, there is provided a lateral folding product guide, the adjustment units being associated with the fan disks and forming a modular construction with the folding product guide. The advantage of such a construction is the space saving configuration of the adjustment units, and the fact that these units can quickly be exchanged and produced at low cost.

In accordance with still another feature of the invention, there are provided stripping tongues disposed at the arms which move with the fan disks. These ensure a continuous stream of folding products on the subsequent conveyor belts.

With the objects of the invention in view, there is also provided in a folder of a web-fed rotary printing machine, a delivery apparatus, comprising a cantilevered shaft, axially movable sliding parts disposed on the cantilevered shaft, delivery systems including fan disks fastened on the axially movable sliding parts, means for operating the delivery systems in parallel, means for driving the delivery systems independently of one another, and connecting rod drives for adjusting the delivery systems independently of one another during machine operation and during machine standstill.

The advantages to be seen with such a construction are that a support of the shaft carrying the delivery systems is no longer necessary and easier access is ensured thereby. Furthermore, it enables a space-saving configuration wherein the drives of the connecting rods can all be placed at the middle wall of the folding apparatus.

Other features which are considered as characteristic for the invention are set forth in the appended claims.

Although the invention is illustrated and described herein as embodied in delivery systems in the folder of a web-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
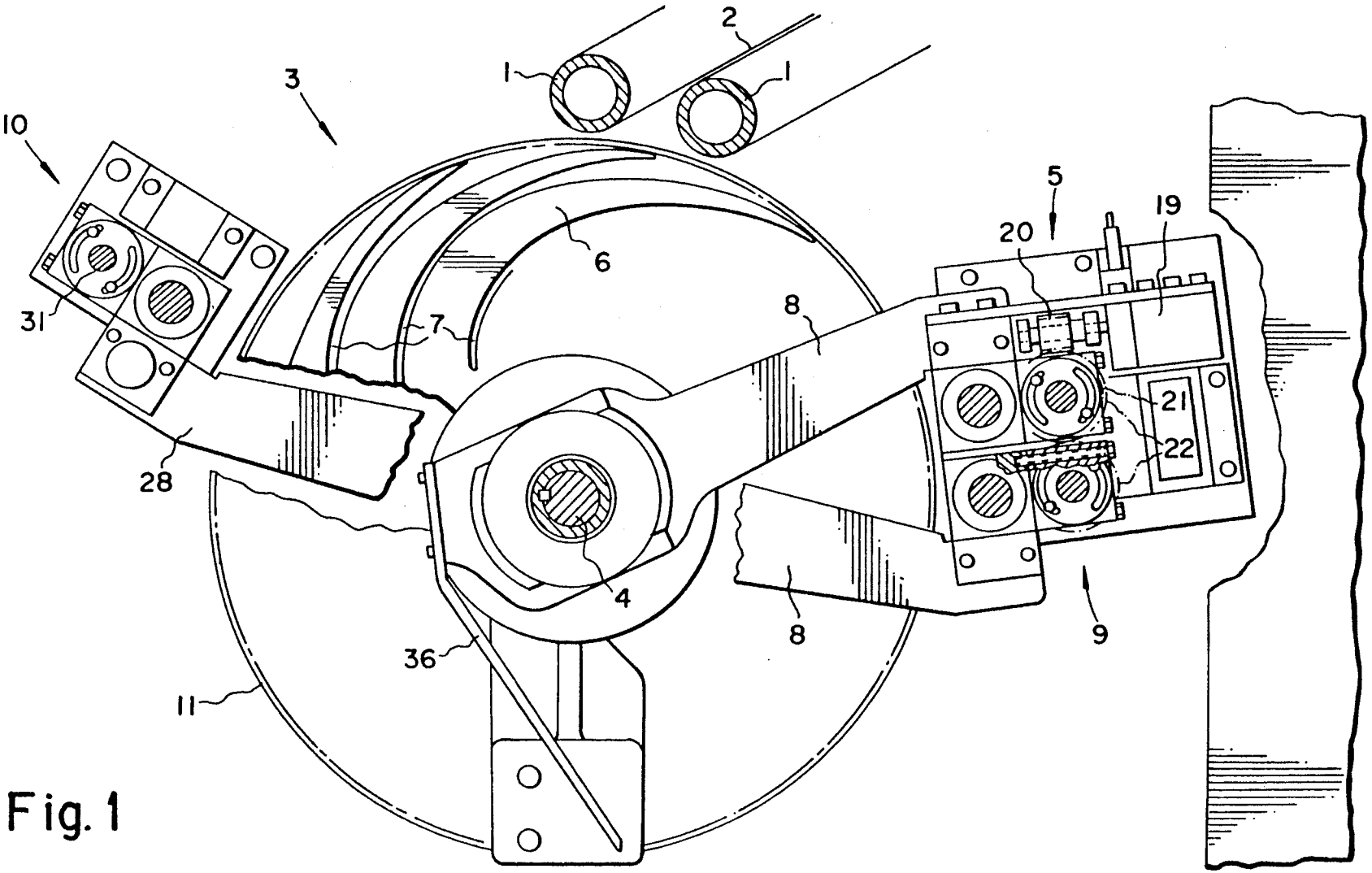
FIG. 1 is a fragmentary, diagrammatic, partly broken-away side-elevational view of a fan disk with conveyor belts, adjustment units for a lateral guide of a folding product stream and fan disks in a modular construction.

Referring now to the figures of the drawing in detail and first, particularly, to FIG. 1 thereof, there is seen a side view of a fan disk together with conveyor belts and adjustment units for a lateral folding product guide as well as fan disks in a modular construction.

A delivery systems 3 of a delivery apparatus includes belts 2 which run on belt rolls 1. The belts 2 convey folded products to fan disks 6 which are disposed next to each other on a shaft 4. The fan disks 6 are constructed with pockets 7 into which folded products are conveyed by the belts 2. Arms 8 are each connected with a respective fan disk 6.

In the right-hand part of FIG. 1, adjustment units 5 and 9 are disposed on top each other in a modular construction. In the left-hand part of FIG. 1 there is seen an adjustment unit 10 by means of which a lateral folding product guide 11 is automatically positionable. At the fan disks 6, strippers 36 are provided which can be screwed onto the arms 8.

Figure 2:
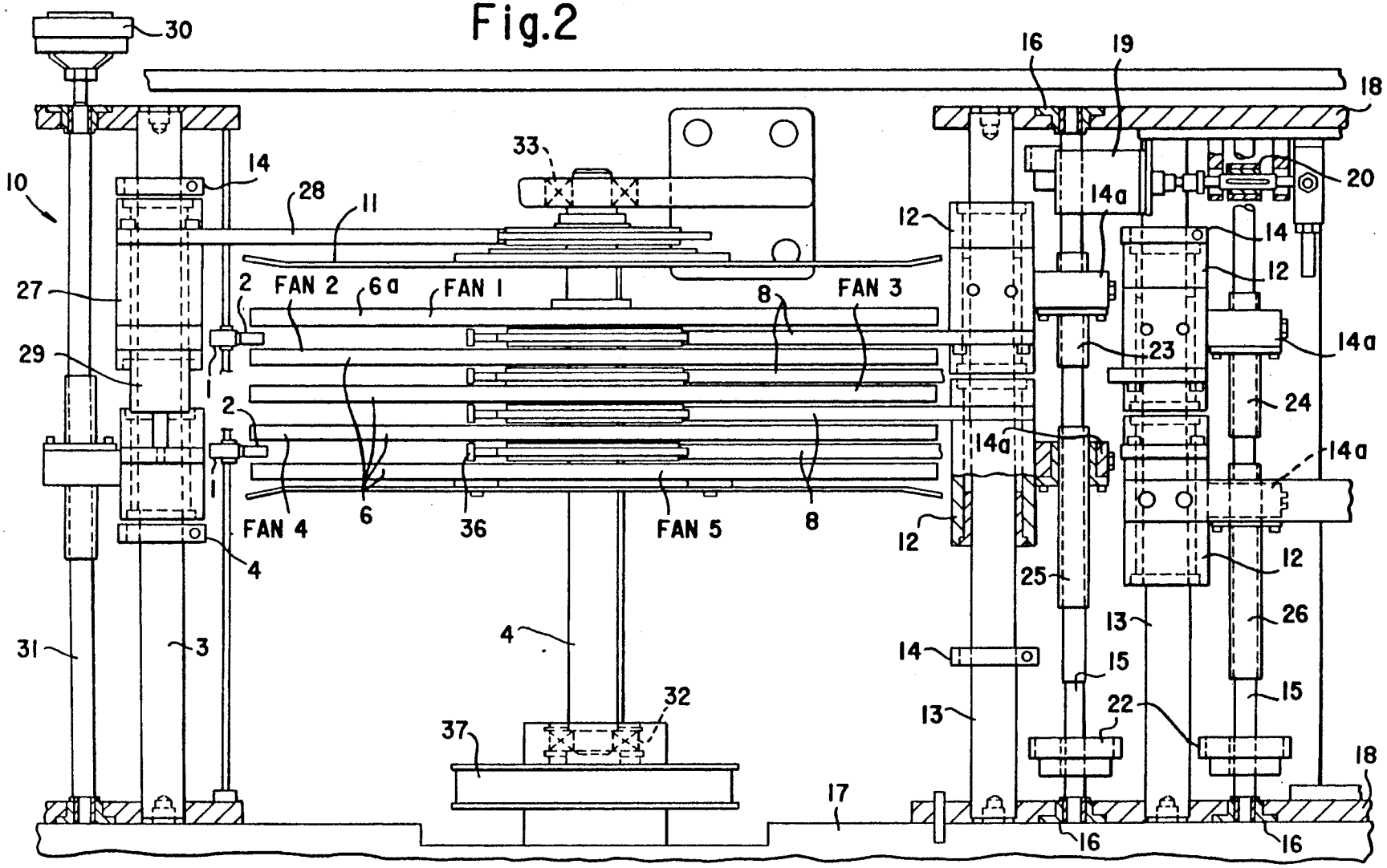
FIG. 2 is a fragmentary, partly sectional, plan view of fan disks being set for the smallest format, with the lateral guide of a folding product stream being disengaged.

FIG. 2 shows a plan view of fan disks that are adjusted to the smallest product format, with the lateral folding product guide 11 in disengagement. The shaft 4 illustrated in the middle of FIG. 1 has four adjustable fan disks 6 which are connected with sliding parts 12 through the arms 8. The sliding parts 12 are disposed on a shaft 13 and are shiftable thereon in both directions. Stoppers 14 being releasably fastened on the shaft 13 serve to delimit the shifting of the sliding parts 12 in axial direction. The sliding parts 12 have spindle heads **14*a* in which power spindles 15 can turn. Ends of the power spindles 15 are connected to bushings 16 which are mounted in side walls 18. An electric motor 19 drives the power spindles 15 through a gearing or transmission being formed of a worm gear 20 and a worm wheel 21**.

The power spindles 15 have threaded sections 23, 24, 25 and 26 in the vicinity of the spindle heads **14*a*. These threadings are of varying lengths or have varying pitches, depending on the respective fan disk 6 to be moved. The threads can either be milled into the power spindles 15 or can otherwise be formed as one or multiple threading. The synchronous adjustment of the fan disks 6 while maintaining equal spacing between them can be accomplished by means of different forms of threading. When an adjustment is made within a minimal and a maximal setting position, the fan disk 6 identified as "fan 5" is to be moved the longest distance. This can be accomplished with the threaded section 26 (which is formed in such a way as to have a high pitch). The fan disk 6 identified by "fan 4" is to be moved the third-longest distance. Consequently, the threading section 25 is formed somewhat shorter than the threading section 26. There, a threading of a less high pitch can be used. Similar relationships apply to "fan 3" and to "fan 2, whereas the shortest threading section 23 is provided for "fan 2", since this fan disk 6 is moved the shortest distance with adjustment. A fan disk 6***a* is fixedly mounted on the shaft 4. If the power spindles 15 are driven by the electric motor 19, a format adjustment is accomplished due to the fact that they are driven simultaneously and the adjustment distance of the fan disks is determined by the lengths of the threading sections 23, 24, 25 and 26. A readjustment is not necessary, since the setting positions are reached with great accuracy.

In place of threaded sections having threadings with varying pitches, the threadings can have varying starts through which the required movement of the fan disks can also be accomplished. The simultaneous automatic adjustment of the fan disks together with the automatic setting of the former permits extremely short make-ready and conversion times during machine operation.

FIG. 2 shows the adjustment unit 10 through which the lateral folding product guide 11 can be engaged and disengaged. The lateral folding product guide 11 is moved through an arm 28, by a sliding part 27 which is shiftably mounted on a shaft 13. In the sliding part 27, a pneumatic cylinder 29 can be provided through which the folding product guide 11 is disengaged pneumatically at machine start-up operation. Furthermore, the folding product guide 11 can be actuated manually through a hand wheel 30, in order to move a fine adjustment spindle 31. As shown in FIG. 1, the adjustment unit 10 for adjusting the lateral folding product guide 11 is manufactured with a modular construction, and thus can be used at the operating side as well as at the driving side. The folding product guide opposite to the folding product guide 11 is connected with the "fan 5" and is moved together with fan disk 6 when adjustment of the latter takes place.

Figure 3:
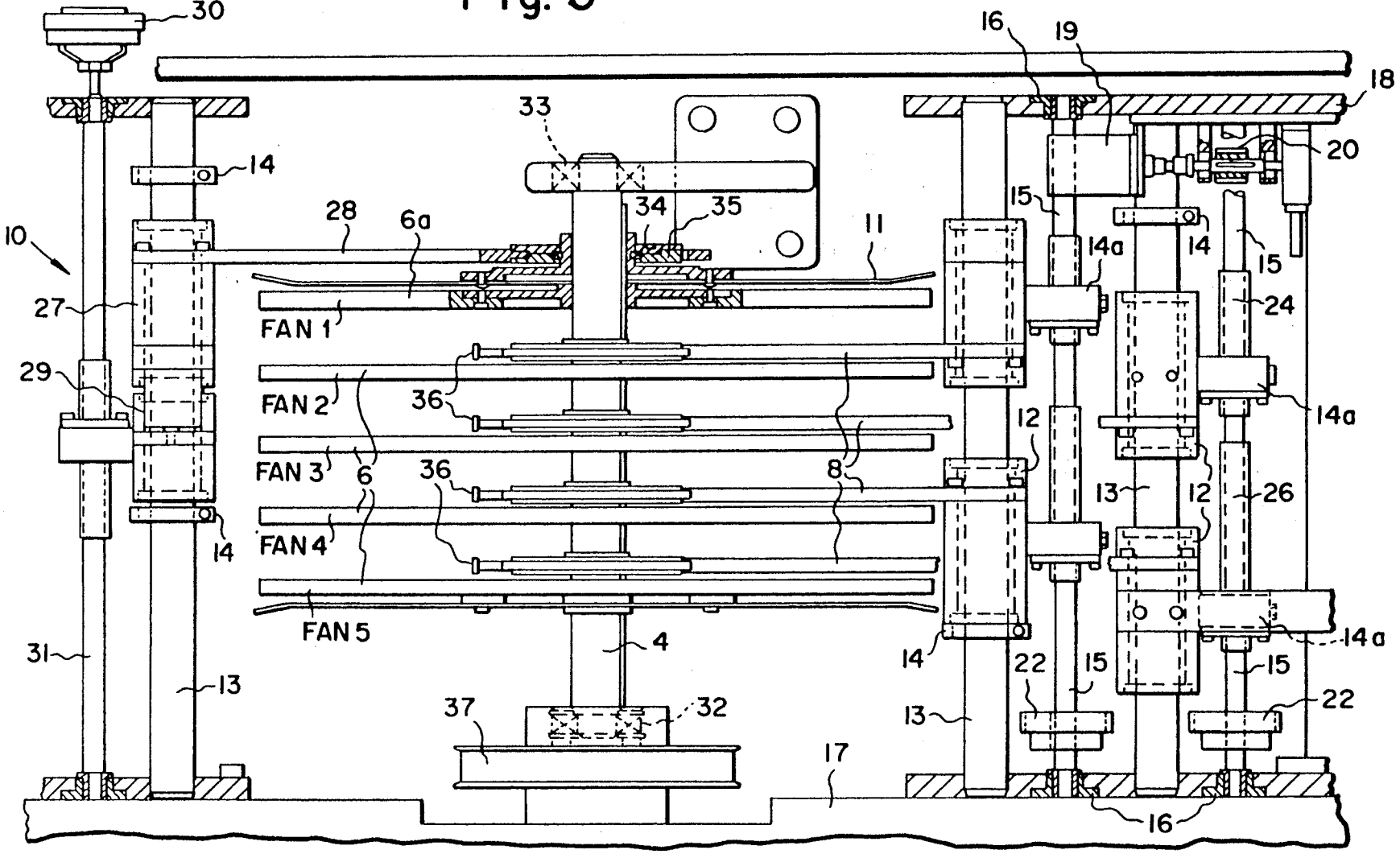
FIG. 3 is a view similar to FIG. 2 of fan disks being set for the largest format with the lateral guide of the folding product stream being engaged.

FIG. 3 illustrates a plan view of fan disks being adjusted to the largest format, with the lateral folding product guide engaged. The fan disks 6 are moved into their maximal setting position on the shaft 4, which is mounted in bearings 32, 33. The lateral folding product guide 11 is in contact with the "fan 1". The sliding parts 12 are brought into the respective setting position through the spindle heads 14*a*. The adjustment distance through which the sliding part 12 has moved is revealed by the position that the spindle head 14*a* has taken on the threaded section 26. In order to reduce friction and to avoid misalignment with the shifting of the fan disks 6, the arms 8 are disposed at the fan disks 6 through bearings 34 on rings 35. Furthermore, the strippers 36 are provided at the arms 8 which guide the folding products out of the pockets 7. A drive wheel 37 is disposed on the shaft 4 next to the bearing 32 so as to permit the shaft 4 to be driven through a belt drive.

FIG. 1 shows the belts 2 including belt guide rolls 1 which approach the periphery of the fan disks 6. As shown in FIG. 2, these belts 2 can extend into the spaces between the individual fan disks 6 at the folding product feed side as well as at the delivery side. With the automatic format adjustment these conveyor belts are movable in accordance with the shiftable fan disks 6 in order to facilitate an optimal product delivery.

Figure 4:
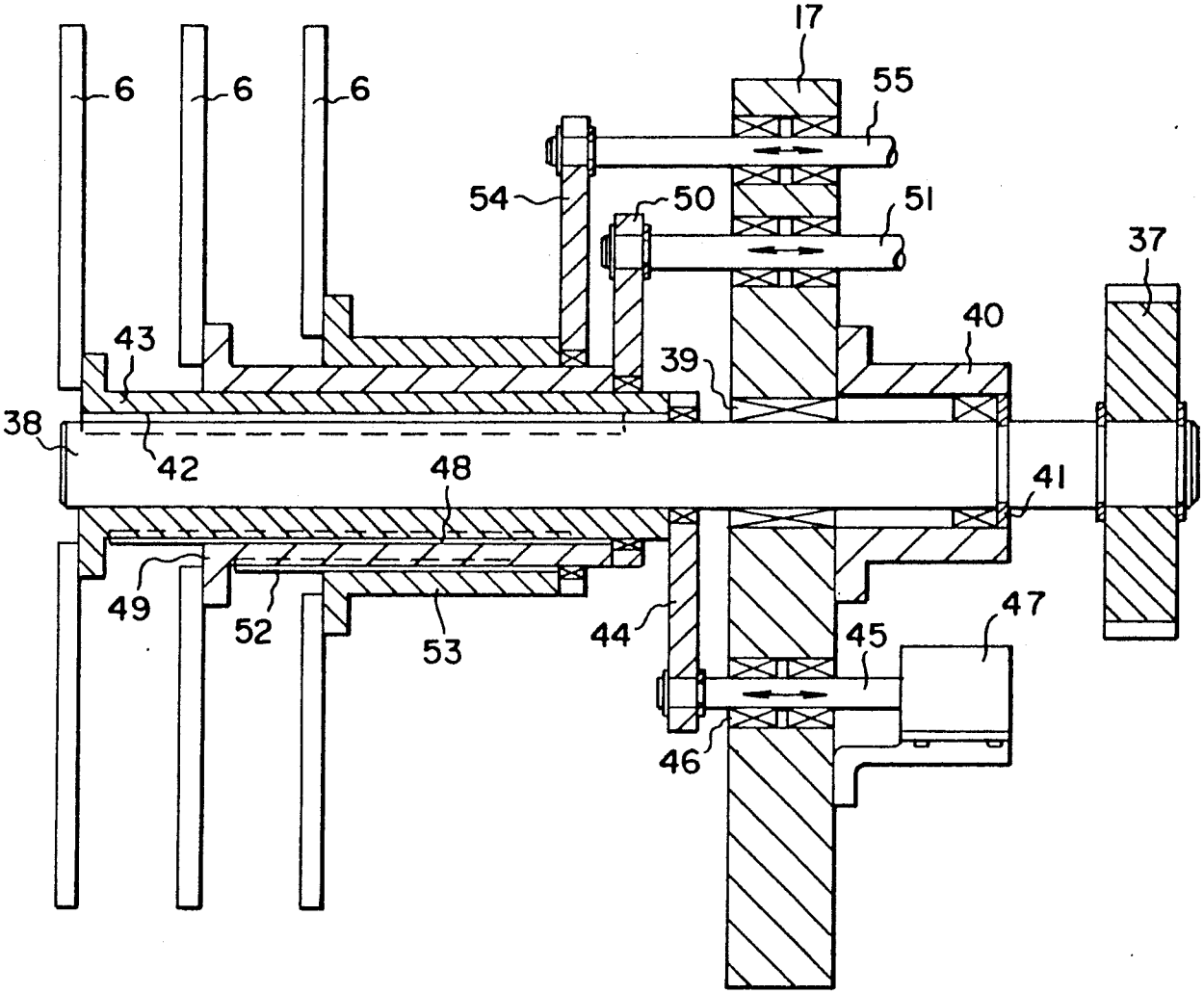
FIG. 4 is a partly sectional view of a cantilevered shaft mounted in a middle wall of a folding apparatus, together with a number of fan sliding parts.

FIG. 4 illustrates one embodiment according to the invention including a cantilevered shaft 38 being mounted in a middle wall 17 of the folding apparatus and showing a number of fan sliding parts. The cantilevered shaft 38 rests on a bearing 39. A support bushing 40 is flanged to the middle wall 17, to which one end of the cantilevered shaft 38 is braced through a support 41. On the cantilevered shaft 38 there is provided a shaft key 42 by means of which the rotation of the shaft 38 is transferred to an axially shiftable sliding part 43. A fan disk 6 is fastened to the sliding part 43. The sliding part 43 is attached to a connecting rod 45 through a pivotably mounted arm 44. The connecting rod 45 is movably mounted on a bearing 46 in the middle wall 17. A connecting rod drive 47 serves to move the connecting rod 45 in axial direction. A key 48 is fastened on the sliding part 43 in order to transfer rotation of the cantilevered shaft 38 through the sliding part 43 onto a sliding part 49. The sliding part 49 is axially shifted through an arm 50 and a connecting rod 51 in the same manner as the sliding part 43. The connecting rod drive for the sliding part 49 is not illustrated.

The sliding part 49 itself has a key 52 which brings a sliding part 53 into rotation and thereby sets the fan disk 6 into motion. The sliding part 53 is shifted through an arm 54 and a connecting rod 55 in the same way as the two sliding parts described above. In this manner, fan disks which are disposed next to each other, can be adjusted in the middle wall of the folding apparatus through setting drives.

Figure 5:
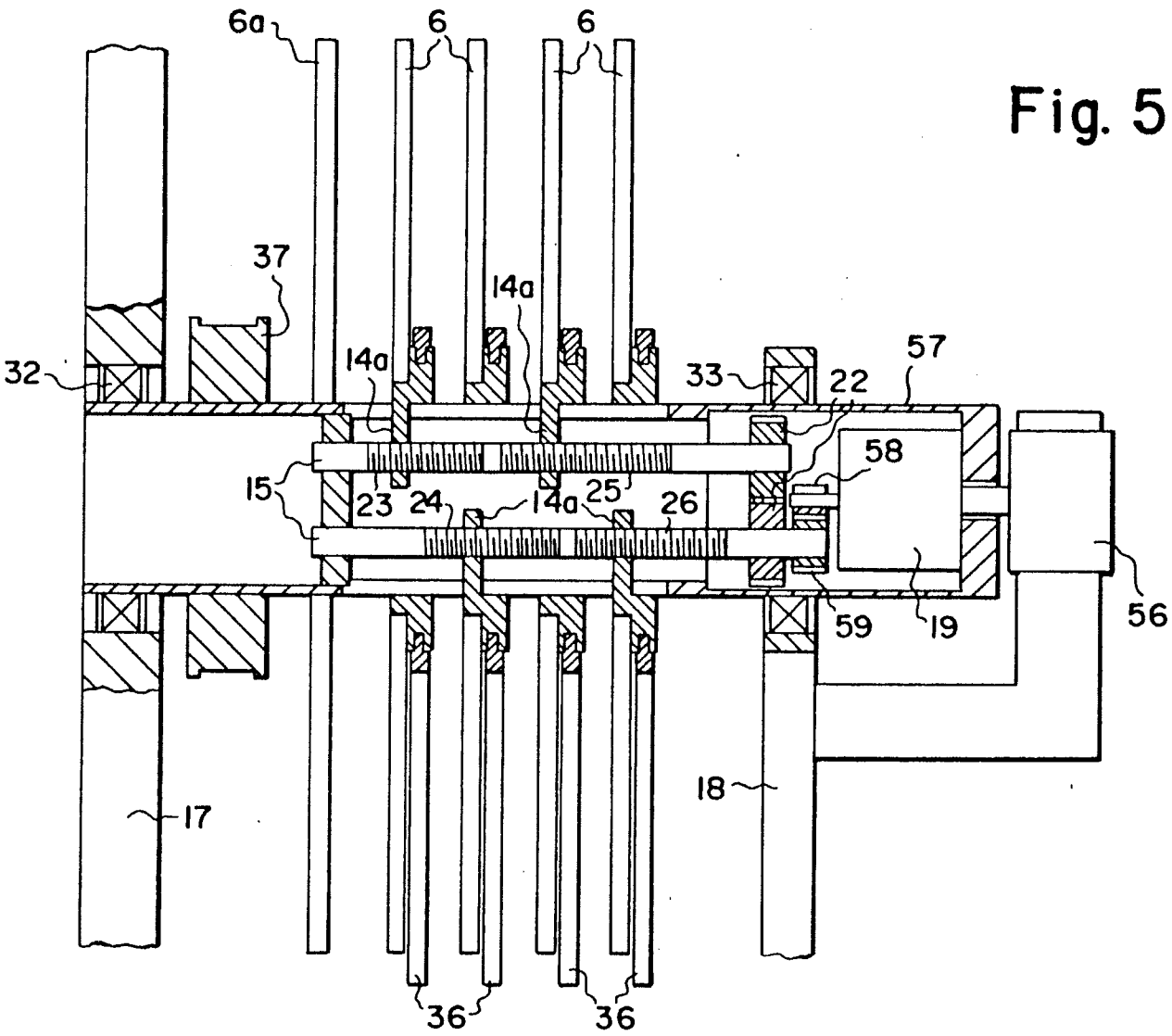
FIG. 5 is a partly sectional view of a construction space saving configuration of an adjustment mechanism.

FIG. 5 illustrates a construction space saving configuration of the adjustment mechanism.

According to this alternative embodiment, a tubular shaft 57 is accommodated between a folder side wall 18 and a middle wall 17, and is rotatably mounted on the bearings 32 and 33. An electric motor 19 is mounted within the tubular shaft 57, in order to drive a first power spindle 15 through a pinion 58 and a gear 59. Through the use of gear wheels 22, the drive is transmitted from a first to a second power spindle 15 which also is mounted in the tubular shaft 57.

In accordance with the embodiments shown in FIG. 2 and 3, the power spindles 15 are provided with the threaded sections 23, 24, 25 and 26 through which the spindle heads 14*a* can move sideways and thereby shift the fan disks 6. Strippers 36 are fastened to the movable fan disks 6 and ride on a rail with a bearing. The fan disk 6*a* is fixed on the tubular shaft 59 and is not shiftable. With the threaded sections 23, 24, 25 and 26 having threadings with different starts, the fan disks 6 can be proportionally shifted sideways. Furthermore, the start of the respective threaded section on the power spindles 15 can be disposed in such a way that a proportional shift in accordance with the moving distance of the respective fan disk 6 can take place. The spindle heads 14*a* are movably disposed in recesses extending parallel to the axis of rotation of the tubular shaft 57, which can be driven through a sprocket 37. The power for the electric motor 19 is supplied through a rotary electrical contact 56. This embodiment enables a space saving accommodation of the adjustment mechanism in a shaft on which the fan disks are disposed. It permits a more simple adjustment of the stripping tongues as well as a less expensive construction.

We claim:

1. In a folder of a web-fed rotary printing machine, a delivery apparatus for transporting products of varying formats in a given transport direction, comprising:

delivery system components disposed relative to one another in accordance with a given product format, said delivery system components including a lateral component and a plurality of further components;

said lateral component being disposed stationary relative to a direction transverse to the given transport direction; and said further components being aligned with one another and with said lateral component in the transverse direction and defining d distance between respective ones of said further components;

adjusting means for adjusting said distance during operation of the folder, said adjusting means including adjustment units for simultaneously shifting said further components in the transverse direction, and means for setting a desired distance between said respective further components within a minimal and a maximal setting position;

said delivery system components including fan disks and belts;

a shaft on which said fan disks are shiftably disposed, arms for moving said fan disks on said shaft, and sliding parts fastened to said arms;

bearings disposed at said fan disks, and rings mounted on said bearings, said arms being fastened on said rings;

folder side walls, bushings supported in said folder side walls, power spindles mounted in said bushings, and an electric motor simultaneously driving said power spindles.

2. The delivery apparatus according to claim 1, including a shaft on which said sliding parts are shiftably disposed, and spindle head moving said sliding parts, said power spindles having threaded sections in the vicinity of said spindle heads.

3. The delivery apparatus according to claim 2, wherein a plurality of said threaded sections, respectively, are formed of single threads of varying pitch.

4. The delivery apparatus according to claim 2, wherein a plurality of said threaded sections, respectively, are formed of multiple threads of varying pitch.

5. The delivery apparatus according to claim 1, wherein said power spindles have threaded sections milled into said power spindles with varying pitch.

6. The delivery apparatus according to claim 2, wherein a plurality of said threaded sections, respectively, are formed of single threads of varying length.

7. The delivery apparatus according to claim 2, wherein a plurality of said threaded sections, respectively, are formed of multiple threads of varying length.

8. In a folder of a web-fed rotary printing machine, a delivery apparatus for transporting products of varying formats in a given transport direction, comprising:

delivery system components disposed relative to one another in accordance with a given product format, said delivery system components including a lateral component and a plurality of further components;

said lateral component being disposed stationary relative to a direction transverse to the given transport direction; and said further components being aligned with one another and with said lateral component in the transverse direction and defining a distance between respective ones of said further components;

adjusting means for adjusting said distance during operation of the folder, said adjusting means including adjustment units for simultaneously shifting said further components in the transverse direction, and means for setting a desired distance between said respective further components within a minimal and a maximal setting position;

said delivery system components including fan disks and belts;

a shaft on which said fan disks are shiftably disposed, arms for moving said fan disks on said shaft, and sliding parts fastened to said arms;

other shafts on which said sliding parts are shiftably disposed, and shiftable stoppers fastened to said other shafts for said shiftable sliding parts.

9. In a folder of a web-fed rotary printing machine, a delivery apparatus for transporting products of varying formats in a given transport direction, comprising:

delivery system components disposed relative to one another in accordance with a given product format, said delivery system components including a lateral component and a plurality of further components;

said lateral component being disposed stationary relative to a direction transverse to the given transport direction; and said further component being aligned with one another and with said lateral component in the transverse direction and defining a distance between respective ones of said further components;

adjusting means for adjusting said distance during operation of the folder, said adjusting means including adjustment units for simultaneously shifting said further components in the transverse direction, and means for setting a desired distance between said respective further components within a minimal and a maximal setting position;

said delivery system components including fan disks having spaces therebetween, and including belts extending into the spaces between said fan disks.

* * * * *